US012680406B2

(12) United States Patent
Bodley et al.

(10) Patent No.: US 12,680,406 B2
(45) Date of Patent: Jul. 14, 2026

(54) INFLATABLE BORE HOLE PLUG

(71) Applicant: MTI GROUP PTY LTD, Wangara (AU)

(72) Inventors: Nicholas Bodley, Wangara (AU); James Fitzsimons, Wangara (AU); Jamie Smith, Wangara (AU)

(73) Assignee: MTI GROUP PTY LTD, Wangara (AU)

( * ) Notice: Subject to any disclaimer, the term of this patent is extended or adjusted under 35 U.S.C. 154(b) by 0 days.

(21) Appl. No.: 18/685,406

(22) PCT Filed: Aug. 24, 2022

(86) PCT No.: PCT/AU2022/050985
§ 371 (c)(1),
(2) Date: Feb. 21, 2024

(87) PCT Pub. No.: WO2023/023758
PCT Pub. Date: Mar. 2, 2023

(65) Prior Publication Data

US 2024/0352815 A1 Oct. 24, 2024

(30) Foreign Application Priority Data

Aug. 24, 2021 (AU) ..... 2021902701

(51) Int. Cl.
*E21B 23/04* (2006.01)
*E21B 33/127* (2006.01)
*E21B 33/134* (2006.01)

(52) U.S. Cl.
CPC ..... *E21B 23/0417* (2020.05); *E21B 33/1277* (2013.01); *E21B 33/134* (2013.01)

(58) Field of Classification Search
CPC ..... E21B 23/00; E21B 33/127; E21B 33/1277
See application file for complete search history.

(56) References Cited

U.S. PATENT DOCUMENTS 4,846,278 A 7/1989 Robbins
2003/0047307 A1 3/2003 Jenkins et al.
(Continued)

FOREIGN PATENT DOCUMENTS

AU 200154104 A1 1/2002
AU 2013222055 B2 3/2014
(Continued)

OTHER PUBLICATIONS

International Preliminary Report on Patentability issued in International Patent Application No. PCT/AU2022/050985, mailed Jul. 26, 2023.
(Continued)

*Primary Examiner* — Kristyn A Hall
(74) *Attorney, Agent, or Firm* — Kim IP Law Group, LLC

(57) ABSTRACT

An inflatable down hole bag for insertion in a bore hole, comprising a sealed inflatable body for holding an inflation fluid; a first substance within the sealed inflatable body; a second substance separated from the first substance within the sealed inflatable body; and a release for allowing the second substance to contact the first substance; wherein release of the second substance causes an inflation fluid producing reaction within the sealed inflatable body, thereby inflating the inflatable body, the sealed inflatable body being vacuum sealed so as to hold in place one or both of the first and second substances prior to the release of the second substance.

21 Claims, 3 Drawing Sheets

(56) References Cited

U.S. PATENT DOCUMENTS

| | | | | |
|---|---|---|---|---|
| 2004/0241292 | A1* | 12/2004 | Geng | B65D 85/36<br>426/128 |
| 2011/0011481 | A1 | 1/2011 | Jenkins et al. | |
| 2020/0048974 | A1 | 2/2020 | Jenkins | |
| 2021/0135180 | A1* | 5/2021 | Kang | H01M 50/342 |

FOREIGN PATENT DOCUMENTS

| | | | |
|---|---|---|---|
| WO | 2012160416 | A1 | 11/2012 |
| WO | 2019143707 | A1 | 7/2019 |
| WO | 2020077419 | A1 | 4/2020 |

OTHER PUBLICATIONS

International Search Report issued in International Patent Application No. PCT/AU2022/050985, mailed Nov. 29, 2022.
Written Opinion issued in International Patent Application No. PCT/AU2022/050985, mailed Nov. 29, 2022.

* cited by examiner

INFLATABLE BORE HOLE PLUG

CROSS-REFERENCE TO RELATED APPLICATION(S)

This is a national stage application filed under 35 U.S.C. § 371 based on International Patent Application No. PCT/AU2022/050985, filed Aug. 24, 2022, which claims priority to Australian Patent Application No. 2021902701, filed Aug. 24, 2021, the disclosures of which are incorporated herein by reference in their entireties.

FIELD OF THE INVENTION

The present invention relates to inflatable bags for use down a drill hole, such as to provide a platform or plug inside of the drill hole.

BACKGROUND

The following discussion of the background art is intended to facilitate an understanding of the present invention only. It should be appreciated that the discussion is not an acknowledgement or admission that any of the material referred to was part of the common general knowledge as at the priority date of the application.

Inflatable bags are known to have reagents, such as a carbonate or bicarbonate salt and an acid, which produce an inflation medium (typically $CO_2$) for inflating the bag when it is lowered inside the drill hole. The reagents need to be kept separate prior to initiating a chemical reaction between them that creates the inflation medium. The problem is that space required for separating the reagents can interfere with the overall dimensions of the bag. This can interfere with the ability to manoeuvre the bag into place within the drill hole before it sets. A problem with existing solutions is the overall dimensions prevent use in certain size holes as well as requiring additional space during transport. An alternative is desired.

Throughout the specification unless the context requires otherwise, the word "comprise" or variations such as "comprises" or "comprising", will be understood to imply the inclusion of a stated integer or group of integers but not the exclusion of any other integer or group of integers.

Throughout the specification unless the context requires otherwise, the word "include" or variations such as "includes" or "including", will be understood to imply the inclusion of a stated integer or group of integers but not the exclusion of any other integer or group of integers.

SUMMARY OF INVENTION

According to a first aspect of the present invention, there is provided an inflatable down hole bag for insertion in a bore hole, comprising:

- a sealed inflatable body for holding an inflation fluid;
- a first substance within the sealed inflatable body;
- a second substance separated from the first substance within the sealed inflatable body; and
- a release for allowing the second substance to contact the first substance;
- wherein release of the second substance causes an inflation fluid producing reaction within the sealed inflatable body, thereby inflating the inflatable body, the sealed inflatable body being vacuum sealed so as to hold in place one or both of the first and second substances prior to the release of the second substance.

In an embodiment, a portion of the inflatable body is formed into a pocket for holding the first substance prior to release of the second substance.

In an embodiment, the pocket remains until at least the inflation fluid is produced.

In an embodiment, a bulk of the first substance is contained within the pocket of the sealed inflatable bag.

In an embodiment, the pocket is defined by the vacuum seal around the bulk of the first substance.

In an embodiment, the second substance is contained within a container.

In an embodiment, holding of the second substance in place is by holding the container in place.

In an embodiment, the container is held in place until the second substance is emptied from the container.

In an embodiment, the release comprises an actuator for releasing the second substance from the container.

In an embodiment, the container comprises an openable closure, wherein the closure keeps the second substance in the container until it is opened by the actuator being activated to release the second substance.

In an embodiment, the container is disposed adjacent to the pocket of the vacuum sealed inflatable body.

In an embodiment, a channel is defined between a bulk of the first substance and the second substances.

In an embodiment, the channel is defined by a vacuum seal around a minority of the first substance positioned between the pocket and the container.

In an embodiment, a border of the channel and the pocket is created by vacuum formed contact between opposed sides of the sealed inflatable body.

In an embodiment, the channel is filled with a trail of the first substance.

In an embodiment, the channel comprises a tubular body or portion thereof.

In an embodiment, continued inflation of the sealed inflatable body following release increases the contact between the first and second substances.

In an embodiment, the first substance comprises a carbonate. Preferably, the first substance comprises a bicarbonate salt.

In an embodiment, the second substance comprises an acid. Preferably, the second substance comprises citric acid. More preferably, the second substance comprises a citric acid solution.

In an embodiment, when the inflatable down hole bag is oriented for lowering into a hole, the pocket and the channel are beneath the container.

In an embodiment, the shape of the pocket corresponds to the shape of a tray.

In an embodiment, the shape of the channel corresponds to the shape of the tray.

In an embodiment, the sealed inflatable body is inside of a scuff bag.

According to a second aspect of the present invention, there is provided a method of inflating a down hole bag, comprising:

- providing an inflatable bag having a sealed inflatable body for holding an inflation fluid, the body comprising a first substance and a second substance separated by a release, wherein the sealed inflatable body is vacuum sealed holding one or both of the first and second substances in place;
- activating the release allowing the second substance to come into contact with the first substance causing an inflation fluid producing reaction within the inflatable body, thereby inflating the inflatable body.

In an embodiment, the method comprises further inflating of the bag which increases contact between the first and second substances.

According to a third aspect of the present invention, there is provided a method of forming an inflatable down hole bag, comprising:

placing a first and second substance within a sealable inflatable body; and vacuum sealing the inflatable body retaining the first and second substances in place relative to each other within the inflatable body wherein the first and second substances are placed in a manner in which the first and second substances are separated until released.

In an embodiment, the method further comprising positioning the first and second substances within the sealable inflatable body by a tray.

In an embodiment, the method further comprises separating the second substance from the first substance by using a container.

In an embodiment, the method further comprises forming a pocket by vacuum sealing a bulk of the first substance. Preferably, the pocket is formed in a recess in the tray.

In an embodiment, the pocket is defined by a border created by the vacuum formed contact between opposed side of the sealable inflatable body.

In an embodiment, the method further comprising forming a channel between the first substance and the second substance. Preferably, the channel is formed in a groove in the tray.

In an embodiment, the method comprises forming a channel vacuum sealing a trail of the first substance from the bulk of the first substance to the container.

In an embodiment, the method further comprising separating the inflatable body from the tray after vacuum sealing.

In an embodiment, the method further comprising inserting the vacuum sealed inflatable body into a scuff bag.

BRIEF DESCRIPTION OF DRAWINGS

In order to provide a better understanding, embodiments of the present invention will be described, by way of example only, with reference to the accompanying drawings, in which.

DESCRIPTION OF EMBODIMENTS

Figure 1:
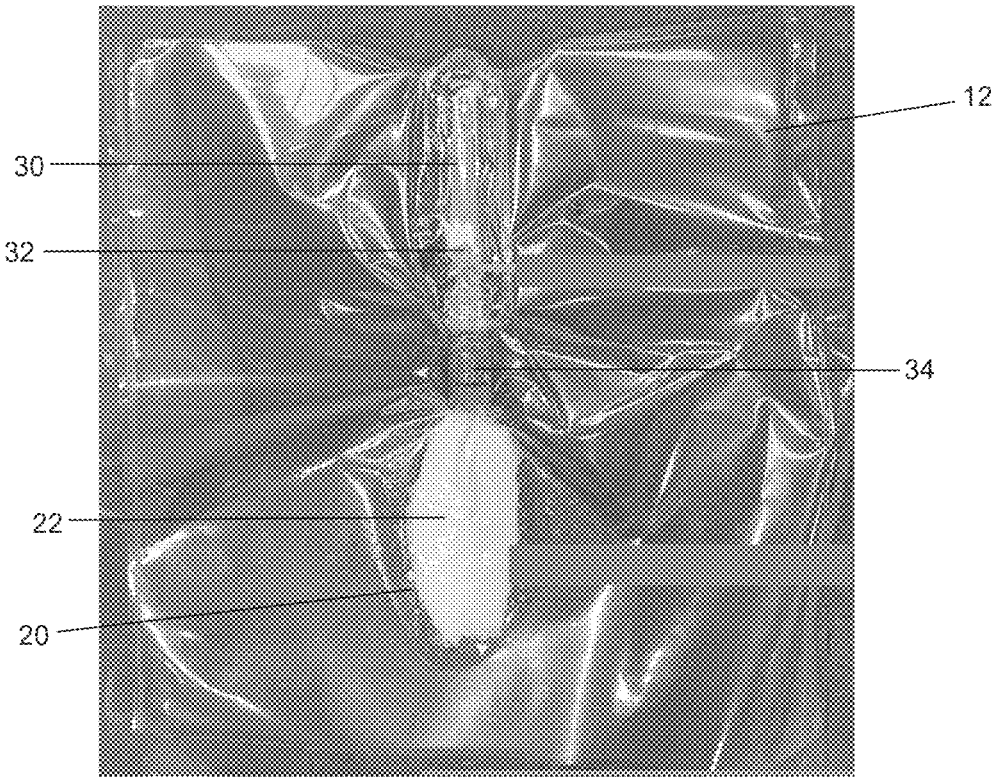
FIG. 1 is a front view of the inflatable down hole bag according to an embodiment of the present invention.

Referring to FIG. 1, there is shown an inflatable body 12 for holding an inflation fluid which has been vacuum sealed to hold its contents in place. The inflatable body 12 comprises a bag comprising at least two opposite sides. The contents of the inflatable body 12 comprise a first substance 22 and a second substance 32. The first substance 22 and the second substance 32 are separated by at least the second substance 32 being contained within a container 30. The container 30 comprises a release, in the form of an openable closure 34, which prevents contact between the first substance 22 and the second substance 32 until desired. The first substance 22 and the second substance 32 are held in place relative to each other by side walls of the inflatable body 12 holding a vacuum formed by vacuum sealing of the inflatable body 12.

Figure 2:
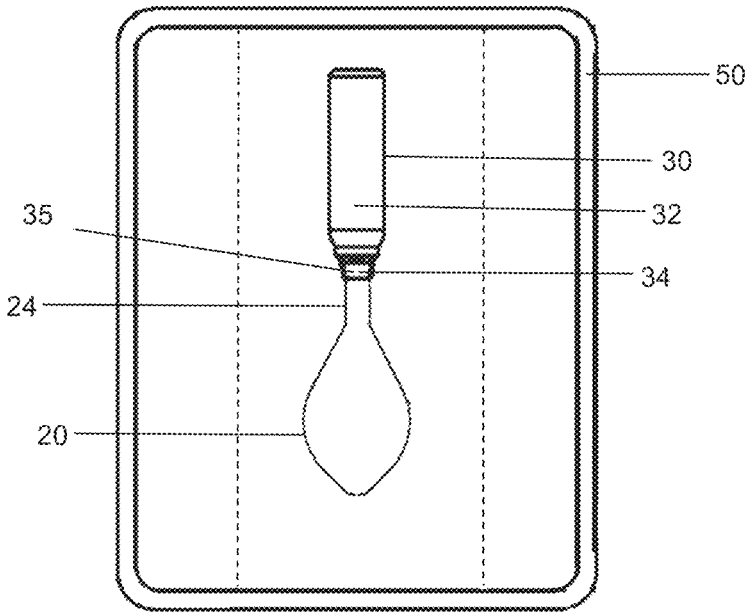
FIG. 2 is a front view of the inflatable down hole bag that is to be formed on a tray according to an embodiment of the present invention.
Figure 3:
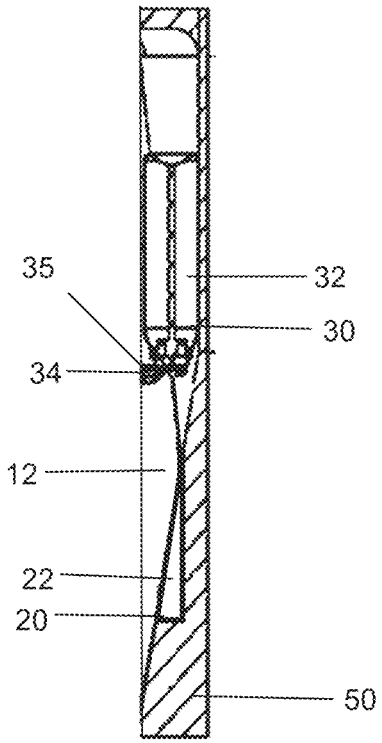
FIG. 3 is a side view of the inflatable down hole bag on a tray of FIG. 1.
Figure 4:
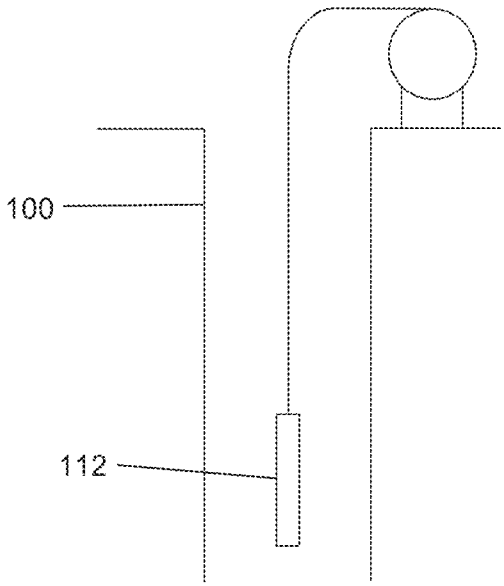
FIG. 4 is a schematic elevation showing insertion of the inflatable down hole bag being lowered in a bore hole on a line.
Figure 6:
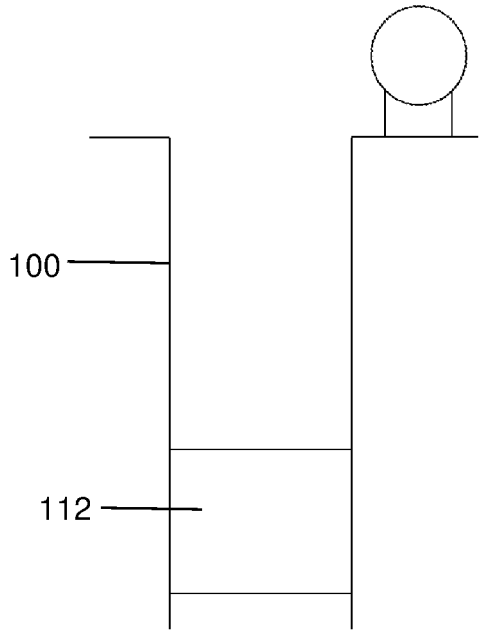
FIG. 6 is the inflatable down hole bag inside the bore hole with the line having been removed.

When desired, the openable closure 34 may be opened by actuating a trigger or tab actuator 35 of the openable closure 34 (see FIGS. 2 and 3). Actuating the openable closure 34 releases the second substance 32 from the container. Once released, the first substance 22 and the second substance 32 are able to come into contact causing an inflation fluid producing reaction. During the reaction, the inflatable body 12 may be inserted within an outer bag, referred to as a scuff bag 112 (which is a wear-resistance bag that protects the inner inflatable bag from puncture), and lowered into a bore hole 100 as can be seen in FIG. 4. The scuff bag 112 provides a more rugged exterior to house the inflatable body 12 to assist in deployment in a potentially abrasive environment which may cause damage to the inflatable body 12 if deployed on its own. Actuation of the openable closure 34 may also occur while the inflatable body 12 is in the scuff bag 112. The inflation fluid inflates the inflatable body 12 inside the scuff bag 112 so as to be able to engage with the walls of the bore hole 100 to create a platform which can support a load, such as an explosive, as seen in FIG. 6.

During the vacuum sealing process, the air from within the bag of the inflatable body 12 is removed causing opposite sides of the inflatable sealed inflatable body 12 to come into contact. A portion of the inflatable body 12 is formed into a pocket 20 for holding the first substance 22 prior to release of the second substance 32. The first substance 22 may be a powder, grains or otherwise particulate, the bulk of which when vacuum sealed may be contained within the pocket 20. The pocket 20 comprises a border defined where the opposite sides of the inflatable body 12 come together during the vacuum sealing process around the first substance 22 or a bulk thereof. Preferably, the pocket 20 will remain until at least the inflation fluid is produced. Once the openable closure 34 of the container 30 is opened and the second substance 32 is released, the second substance 32 will migrate to come into contact with the first substance 22 held within the pocket 20. As the reaction occurs, the inflatable body 12 will begin to expand progressively separating the opposing sides of the inflatable body 12.

As mentioned above, the second substance 32 is contained within a container 30. The holding of the second substance 32 in place by vacuum sealing is by holding the container 30 in place within the inflatable body 12. The placing of the first substance 22 and the second substance 32 relative to each other is arranged adjacent to each other so that release of the second substance 32 from the container 30 allows immediate contact between the first and second substances 22, 32. Preferably, the container 30 may be held in place until the second substance 32 has been emptied from the container 30.

As mentioned above, the release comprises the openable closure 34 that keeps the container 30 closed until the second substance 32 is to be released. The openable closure 34 comprises an actuator which may be actuated to open the openable closure 34 so as to release the second substance 32 from the container 30. The actuator may be in the form of a tab or trigger which an application of pressure will result in offset apertures aligning or a lid or cover being removed such that the second substance 32 can be emptied from the container into the inflatable body 12.

As discussed above, it is preferable that the first substance 22 and the second substance 32 be positioned adjacent to each other within the inflatable body 12 when vacuum sealed. To achieve this end, the container 30 should be positioned adjacent to the pocket 20. In some instances, there may be an overlap between the openable closure 34 and the pocket 20 or a channel 24.

Referring to FIG. 2, there is provided an alternative embodiment of the present invention wherein the pocket 20 holding the first substance 22 is spaced apart from the container 30 holding the second substance 32 by the channel 24. The channel 24 connects the container 30 and the pocket 20 so as to facilitate mixing of the first and second substances 22, 32. In one embodiment, the channel 24 may be formed by providing a trail of the first substance 22 between an edge of the pocket 20 holding the bulk of the first substance 22 and the container 30. The presence of the trail of the first substance 22 will interfere with the opposing sides of the inflatable body 12 from contacting each other during vacuum sealing. The channel 24 in such a case would be filled with the trail of the first substance 22 leading from the bulk of the first substance to at or adjacent to the openable closure 34 of the container 30. In this instance, the second substance 32 will come into contact with the trail of the first substance 22 in the channel 24 almost immediately upon opening the openable closure 34. The channel 24 in such an instance would be defined by the border at the edges of the trail of the first substance, similar to the border surrounding the pocket 20. Preferably, the border may be a continuous border around the channel 24 and the pocket 20 as can be seen in FIG. 2.

In an alternative embodiment, the channel 24 may be formed by a physical body, for example a tubular or portion thereof (not shown). The body would interfere with a portion of the opposing sides of the inflatable body 12 coming into contact with each other upon vacuum sealing. The body may extend from a periphery of the pocket 20, or in some cases may even be partially disposed within the pocket 20 and the first substance 22, to a position adjacent to the container 30 and preferably the openable closure 34. During vacuum sealing, such as by using a Multivac machine, a void within the body is evacuated of air to become a vacuum until the openable closure 34 is opened thereby releasing the second substance 32 to flow through the channel to the first substance 22 within the pocket 20. The channel 24 in each case is therefore defined between a bulk of the first substance 22 and the second substance 32.

Once the second substance 32 is released from the container 30, the inflation fluid producing reaction begins. As the second substance 32 mixes with the first substance 22, either in the channel 24 or in the pocket 20, the opposing sides of the inflatable body may begin to separate allowing more of the second substance 32 to contact more of the first substance 22 thereby increasing the inflation fluid producing reaction.

The first substance 22 and the second substance 32 are chosen based on their ability to react and the products of said reaction. In the present embodiment, the first substance 22 comprises a carbonate, preferably a bicarbonate salt such as $NaHCO_3$, (although other types of substance are possible) and the second substance 32 comprises an acid, such as citric acid. To assist in the ability of the second substance 32 to flow as well as mix with the first substance 22, the second substance 32 comprises an aqueous citric acid solution, although other types of acid are possible. In alternative embodiments, the positions of the first substance 22 and the second substance 32 may be switched. Furthermore, the first substance 22 may be provided in a solution, such as a carbonate solution whereas the second substance 32 may be provided in a solid, powder or granular form, such as an anhydrous citric acid. Even further, providing the first or second substance 22, 32 in a solid tablet form may also reduce the surface area available for reacting with the other of the substances such that the reaction is delayed providing time to lower the inflatable body 12 into the bore hole 100 to a desired position. However, the person skilled in the art would appreciate that any number of substances may be paired together whose reactions produce a fluid capable of inflating the inflatable body 12.

Figure 5:
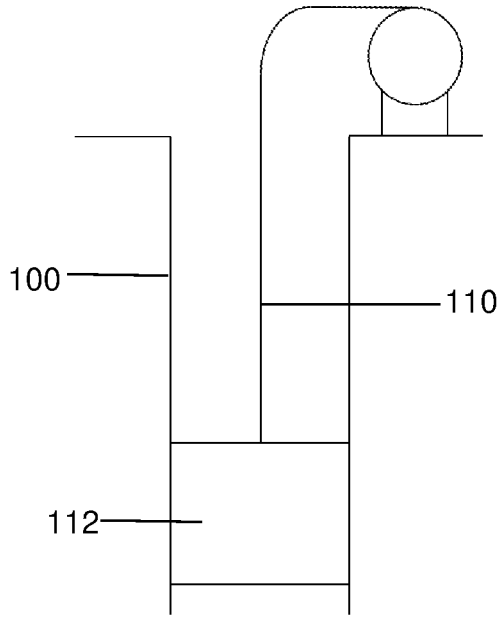
FIG. 5 is a schematic elevation showing the inflatable down hole bag being inflated inside the bore hole.

Referring to FIGS. 4, 5 and 6, the scuff bag 112 having the vacuum sealed inflatable body 12 within will be oriented for lowering into the bore hole 100 such that the pocket 20 is below the container 30. Accordingly, in an alternative embodiment wherein the inflatable body 12 comprises the channel 24, the channel 24 and the pocket 20 would be beneath the container 30. Preferably, the openable closure 34 will open towards the pocket 20 holding the first substance 22. In this orientation, the influence of gravity on the second substance 32 within the container 30 assists in the emptying of the second substance 32 from the container 30. Additionally, or alternatively the container 30 may be pressurised such that on opening the second substance is urged out of the container 30 due to a pressure differential between the interior of the container 30 and the vacuum in the sealed inflatable body 12.

Said orientation may be achieved by attaching a line 110, which may be a string, rope or similar to an edge of the scuff bag 112 nearest the container 30. The person skilled in the art would readily appreciate that there are a number of ways in which the inflatable body 12 on its own or within the scuff bag 112 may be lowered into the bore hole 100. The inflatable body 12 may be lowered manually by a user or attached to reel for or other apparatus to ensure accuracy of the depth that the inflatable body 12 is deployed.

Referring to FIGS. 2 and 3, the process of separating and positioning the each of the contents within the inflatable body 12 may be further simplified by use of a forming tray 50 (hereinafter referred to as 'tray'). Each of the contents within the inflatable body 12 may be positioned based on an indicia or feature present in or on the tray 50. To begin, the inflatable body 12 having at least an opening for inserting the contents of the inflatable body 12 therein is laid on top or against the tray 50. The tray 50 may comprise one or more recesses 52 for directing where to deposit the bulk of the first substance 22 sits on the bottom side wall and/or the trail of first substance 22 may be received in a groove forming the channel 24 in the bottom side wall between the pocket 20 and the container 30. The tray 50 may also comprise a projection 54 having a complementary shape to a surface of the container such that the container 30 can be temporarily received, abut or otherwise engage with one or more features of the tray 50 to locate at least each of the pocket 20, first substance 22, container 30 and second substance 32 relative to each other.

In the present embodiment, the shape of the pocket 20 may correspond to the shape of the recess 52 of the tray 50. Similarly, the shape of the channel 24 may also correspond to the shape of another recess or groove of the tray 50. The, or each, recess may also assist in determining the volume of the first substance 22 for each of the pocket 20 and the trail of the first substance 22 in the channel 24. For example, the recess 52 may be shaped such that a user need only fill the recess 52 with first substance such that it is at least level with the upper edges of the recess 52. Additionally, the tray 50 and/or the inflatable body 12 may comprise fold lines to assist in aligning the inflatable body 12 with the tray 50 and/or preparing the inflatable body 12 for insertion into the scuff bag 112.

For consistent production purposes, each of the first and second substances 22, 32, the pocket 20, the container 30, and if desirable, the channel 24, is preferably positioned in the same place within the inflatable body 12. Furthermore, this would also assist in the production of the tray 50 to be used for preparing the invention. Such practice ensures efficient performing of the invention.

A method of use will now be described with respect to the Figures generally.

There is provided a method of forming a down hole bag by providing an inflatable body 12 which is able to be vacuum sealed to hold an inflation fluid. Forming the inflatable body 12 may comprise abutting sheets of a flexible material and sealing about a periphery of the sheets to define a cavity for receiving the first and second substances 22, 32. Alternatively, forming the inflatable body 12 may comprise folding an elongated piece of a flexible material such that it overlaps itself and sealing about a periphery of the material to define a cavity for receiving the first and second substances 22, 32.

In preparing the inflatable body 12, the tray 50 may be used to assist in positioning at least the first and second substances 22, 32 within the inflatable body 12. The tray 50 may comprise visual indicia and/or physical features which assist in the positioning and/or quantity of the first and second substances 22, 32 to be positioned within the inflatable body 12. Vacuum sealing the inflatable body 12 after the amounts of the first and second substances 22, 32 have been inserted and positioned within the inflatable body 12.

The first substance 22 and the second substance 32 are inserted separated by a release including the openable closure 34. Separation of the second substance 32 from the first substance 22 occurs by placing the second substance in the container 30 closed by the openable closure 34. The inflatable body 12 is vacuum sealed keeping the first and second substances 22, 32 in place so that they remain separated until released. Inwardly directed pressure from the side walls resulting from the vacuum sealing further retains the contents of the inflatable body in place relative to each other. The inflatable body 12 is then removed from the tray and inserted in the scuff bag.

The inflatable body 12 is separated from the tray 50 after vacuum sealing. Before separating, the method may further comprise folding the inflatable body 12 to prepare for insertion into the scuff bag 112 so as to form the inflatable down hole bag. The tray 50 and/or the inflatable body 12 may have visual and/or physical indicia of where the folding of the inflatable body 12 should occur. For example, the tray 50 and/or the inflatable body 12 may comprise dashed folding lines 56 etched into an upper layer of the material or painted on. These folding lines may assist when beginning the process of preparing an inflatable body for vacuum sealing.

Prior to inflatable down hole bag being lowering into a bore hole 100, the openable closure 34 is activated to release the second substance 32 from the container 30 allows contact between the first and second substances 22, 32. The reaction between the first and second substances 22, 32 produces the inflation fluid. In the present embodiment, the inflation fluid is carbon dioxide (also referred to as $CO_2$). Different inflation fluids would be suitable based on the substances used in the inflatable body. Inflating the inflatable body 12 further separates the opposing sides of the inflatable body 12 thereby allowing further contact between the first and second substances 22, 32.

Once the activation of the release occurs the inflatable down hole bag is lowered into the bore hole by the line 110. Once it is sufficiently inflated it will be self supporting by outward pressure of the wall of the inflatable down hole bag on the walls of the bore hole.

The skilled reader would readily appreciate the nature of the materials appropriate for making the components of the embodiments of the arrangements described herein. Modifications and variations as would be apparent to the skilled addressee are intended to be covered by the accompanying claims.

Future patent applications maybe filed in Australia or overseas on the basis of, or claiming priority from, the present application. It is to be understood that the following claims are provided by way of example only and are not intended to limit the scope of what may be claimed in any such future application. Features may be added to or omitted from the provisional claims at a later date so as to further define or re-define the invention or inventions.

The invention claimed is:

1. An inflatable down hole bag for insertion in a bore hole, comprising:

a sealed inflatable body for holding an inflation fluid;

a solid state of matter first substance within the sealed inflatable body;

a liquid state of matter second substance separated from the first substance within a container, which is within the sealed inflatable body; and a release for allowing the second substance to exit the container to contact the first substance;

wherein release of the second substance causes an inflation fluid producing reaction within the sealed inflatable body, thereby inflating the inflatable body, the sealed inflatable body being vacuum sealed so as to hold in place the first substance and container holding the second substance prior to the release of the second substance, wherein the vacuum sealed inflatable body defines a first chamber holding the first substance in place and a second chamber holding the container in place, wherein the release acts as a closure providing the separation of the second substance from the first substance when the closure is closed, and the release provides a fluid connection between an inside of the container and the first chamber, so that the second substance is released to contact the first substance, when the closure is opened.

2. An inflatable down hole bag according to claim 1, wherein a portion of the inflatable body is formed into a pocket for holding the first substance prior to release of the second substance, wherein the first chamber comprises the pocket.

3. An inflatable down hole bag according to claim 2, wherein more than 50% of the first substance is contained within the pocket of the sealed inflatable bag.

4. An inflatable down hole bag according to claim 3, wherein the pocket is defined by the vacuum seal around the more than 50% of the first substance.

5. An inflatable down hole bag according to claim 2, wherein a channel is defined between more than 50% of the first substance and the second substance.

6. An inflatable down hole bag according to claim 5, wherein the channel is defined by than 50% of the first substance positioned between the pocket and the container.

7. An inflatable down hole bag according to claim 5, wherein a border of the channel and the pocket is created by vacuum formed contact between opposed sides of the sealed inflatable body.

8. An inflatable down hole bag according to claim 5, wherein the channel is filled with a trail of the first substance.

9. An inflatable down hole bag according to claim 5, wherein the channel comprises a tubular body or portion thereof.

10. An inflatable down hole bag according to claim 2, wherein the first and second substances are positioned within the inflatable body by use of a tray.

11. An inflatable down hole bag according to claim 10, wherein the shape of the pocket corresponds to the shape of the tray.

12. An inflatable down hole bag according to claim 1, wherein the container is held in place until the second substance is emptied from the container.

13. An inflatable down hole bag according to claim 1, wherein the release comprises an actuator for releasing the second substance from the container.

14. An inflatable down hole bag according to claim 13, wherein the container comprises an openable closure, wherein the closure keeps the second substance in the container until it is opened by the actuator being activated to release the second substance.

15. An inflatable down hole bag according to claim 1, wherein the container is disposed adjacent to the pocket of the vacuum sealed inflatable body.

16. An inflatable down hole bag according to claim 1, wherein continued inflation of the sealed inflatable body following release increases the contact between the first and second substance.

17. A method of inflating a down hole bag, comprising:

providing an inflatable bag having a sealed inflatable body for holding an inflation fluid, the body comprising a solid first substance and a liquid second substance in a container, the first and second substance being separated by a release, wherein the sealed inflatable body is vacuum sealed holding the first substance in place and container holding the second substances in place;

activating the release allowing the second substance to come into contact with the first substance causing an inflation fluid producing reaction within the inflatable body, thereby inflating the inflatable body.

18. A method of inflating a down hole bag according to claim 17, wherein further inflating of the bag increases contact between the first and second substances.

19. A method of forming an inflatable down hole bag, comprising:

placing a first solid substance and a container holding a liquid second substance within a sealable inflatable body; and vacuum sealing the inflatable body retaining the first substance and the container in place relative to each other within the inflatable body, wherein the first substance and container are placed in a manner in which the first and second substances are separated until released.

20. A method of forming an inflatable down hole bag according to claim 19, further comprising positioning the first and second substances within the sealable inflatable body using a forming tray and the first substance is in the form of a particulate substance.

21. A method of forming an inflatable down hole bag according to claim 19, the method further comprising forming a channel between opposed side of the sealable body.

* * * * *